US006748930B2

(12) United States Patent
Bofinger et al.

(10) Patent No.: US 6,748,930 B2
(45) Date of Patent: Jun. 15, 2004

(54) MECHANICAL DISTRIBUTOR INJECTION PUMP HAVING COLD-START ACCELERATION

(75) Inventors: Guenter Bofinger, Vaihingen (DE); David Banham, Gerlingen (DE); Volker Freudl, Remseck-Pattonville (DE)

(73) Assignee: Robert Bosch GmbH, Stuttgart (DE)

( * ) Notice: Subject to any disclaimer, the term of this patent is extended or adjusted under 35 U.S.C. 154(b) by 14 days.

(21) Appl. No.: 10/301,057

(22) Filed: Nov. 21, 2002

(65) Prior Publication Data

US 2003/0121504 A1 Jul. 3, 2003

(30) Foreign Application Priority Data

Nov. 21, 2001 (DE) ..... 101 56 989

(51) Int. Cl.[7] ..... F02M 37/04
(52) U.S. Cl. ..... 123/502
(58) Field of Search ..... 123/502, 179.16, 123/179.17

(56) References Cited

U.S. PATENT DOCUMENTS 4,345,566 A * 8/1982 Hammock ..... 123/502
4,422,428 A * 12/1983 Eheim ..... 123/502
4,733,645 A * 3/1988 Hain et al. ..... 123/502
5,033,441 A * 7/1991 Hain ..... 123/502
5,243,943 A * 9/1993 Bofinger et al. ..... 123/502

* cited by examiner

*Primary Examiner*—Thomas N. Moulis
(74) *Attorney, Agent, or Firm*—Kenyon & Kenyon

(57) ABSTRACT

A high-pressure pump for supplying internal combustion engines with fuel includes a housing, on which a timing unit for displacing the point of injection is accommodated. The timing unit includes an injection timing piston having inlet bores, and a regulating slide, whose face facing a cold-start accelerator piston has a prestress force applied to it, is movably accommodated in the injection timing piston. A spring element, which is applied directly to the injection timing piston, as well as a spring assembly, which is independent of the spring element and accommodated on a carrier and act on the regulating slide, are positioned between the cold-start accelerator piston and the opposing face of the injection timing piston.

12 Claims, 7 Drawing Sheets

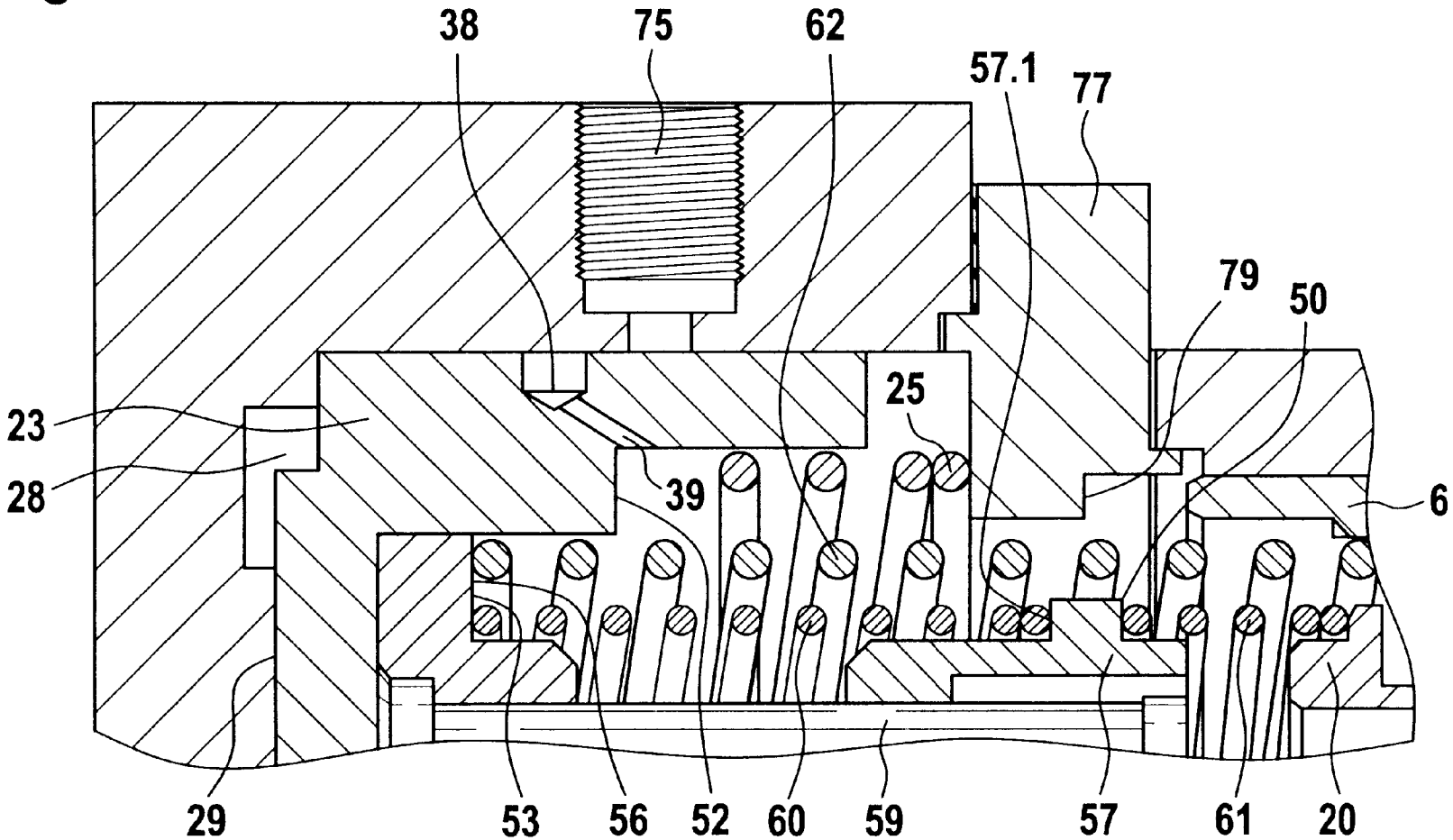
Fig. 5.1

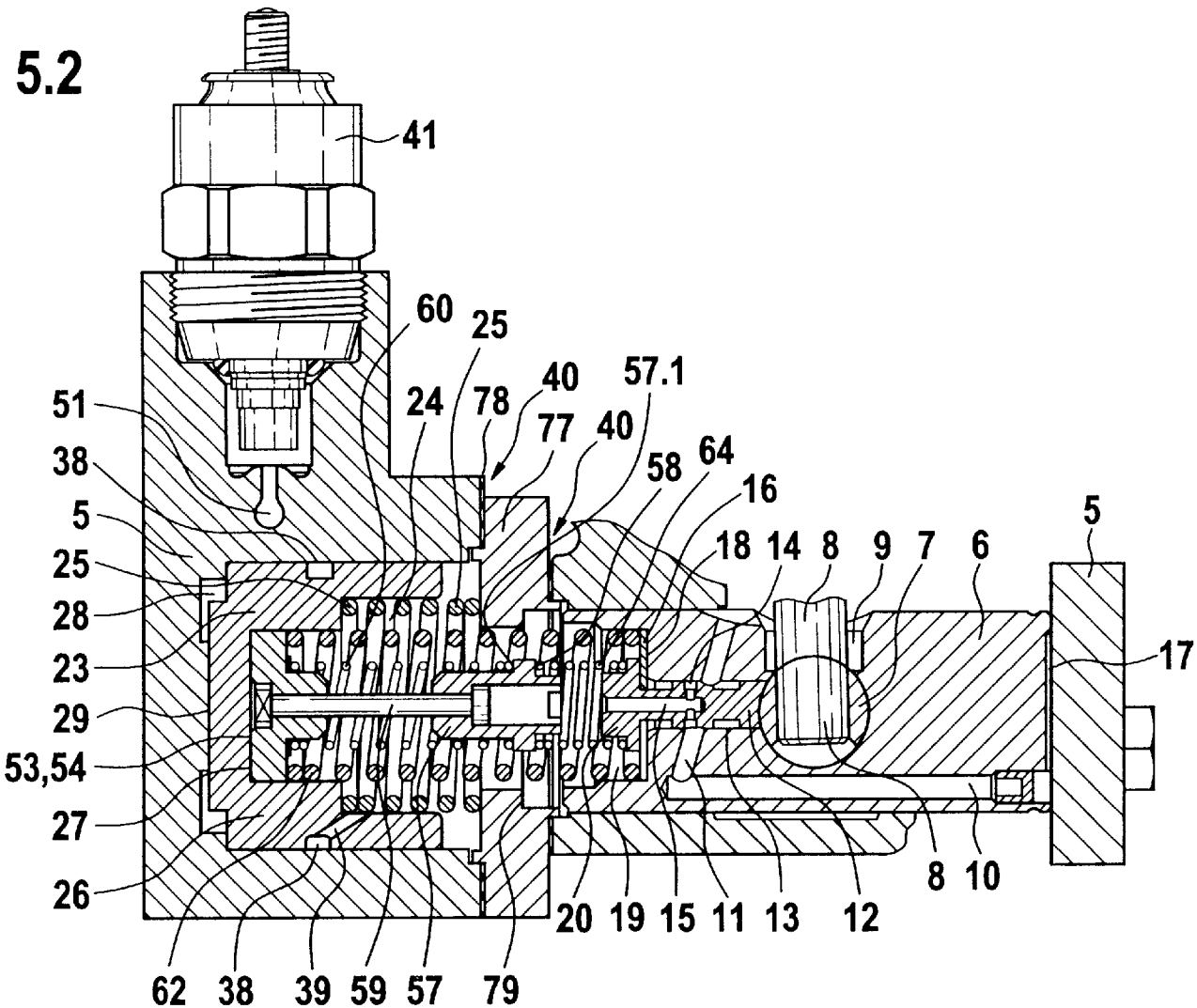
Fig. 5.2

MECHANICAL DISTRIBUTOR INJECTION PUMP HAVING COLD-START ACCELERATION

FIELD OF THE INVENTION

The present invention relates to distributor injection pumps. More particularly, the present invention relates to a high-pressure pump for supplying fuel to an internal combustion engine.

BACKGROUND INFORMATION

Because of continuously increasing requirements due to stricter exhaust regulations for gasoline engines and compression-ignited internal combustion engines, the point of injection, in particular for compression-ignited internal combustion engines, should be adjusted to the particular operating phase of the engine. In the cold-running phase, in particular at low outside temperatures, the point of injection may need to be advanced at diesel distributor injection pumps, thus making a low-emission start with reduced particle emission and reduced noise, as well as a subsequent emission-free cold-running phase possible. As the rotational speed of the internal combustion engine increases, the delivery start of the injection pump should be advanced in order to compensate for the time shift caused by delayed injection and ignition.

After the injection operation, diesel fuel may require a certain time period to pass from the liquid state into the gaseous state and, in this state, to form an ignitable mixture with the combustion air which self-ignites at high pressure. The time period between the injection start and combustion start is discussed in regards to compression-ignited internal combustion engines as ignition delay. The ignition delay is determined, among other factors, by the ignitability of the diesel fuel (expressed by the cetane number), the achievable compression ratio $\epsilon$ of the compression-ignited internal combustion engine, and the quality of the fuel atomization by the injection nozzle of the fuel injector. The ignition delay of compression-ignited internal combustion engines is usually on the order of magnitude of 1 to 2 ms. During the cold-running phase at low outside temperatures, this time period becomes longer, resulting in soot production by the uncombusted fuel, which is discharged into the environment through the exhaust system.

In the case of distributor injection pumps of compression-ignited engines, different cold-start acceleration measures may be used. A hydraulic measure for start acceleration is to temporarily raise the internal pressure of the distributor injection pump during the cold start and during the immediately subsequent cold-running phase of compression-ignited internal combustion engines. As the internal pressure is raised, an injection start timing piston is displaced, resulting in the injection start being advanced. The disadvantage of this measure may be the subsequent loose run of the injection timing piston due to the slow increase in pressure in the interior of the distributor injection pump.

Another option for advancing the injection start is to advance the injection timing piston and thus the injection start by rotating a component designed as a roller ring during the start and during the cold-running phase of the compression-ignited internal combustion engine. Another measure for cold start acceleration which may be carried out using mechanical means is to displace the injection timing piston by pressing on one side of the injection timing piston using a cam shaft so that the injection start is advanced.

The above-mentioned measures may have the disadvantage that only a small amount of adjustment is possible, limited by the mechanical overstress of the components involved, and thus only a limited advance of the injection start is achievable.

FIG. 1 shows a high-pressure pump having an advance timing unit, as is conventional in the related art.

High-pressure pump 1 includes a housing 2, on whose lower side a timing unit 5 for displacing the point of injection is flange-connected. Timing unit 5 for displacing the point of injection includes a two-part housing, a gasket plate being inserted at a housing joint 40 between the halves of the housing of timing unit 5 and housing 2 of high-pressure pump 1.

Timing unit 5 for displacing the point of injection includes a displaceably mounted injection timing piston 6. A pivot bearing 7, which is used to receive a lever, is positioned inside injection timing piston 6. Using this lever, a roller ring of a high-pressure pump 1 may be adjusted within housing 2 in such a manner that the point of injection of fuel into the combustion chambers of an internal combustion engine is displaced.

This lever is also referred to as a timing pin of an injection timing piston for adjusting the roller ring.

The lever accommodated in pivot bearing 7 of injection timing piston 6 extends through an orifice 9 in the injection timing piston, which is dimensioned in such a manner that a pivoting movement of the lever of pivot bearing 7 within injection timing piston 6 is possible. Injection timing piston 6 is penetrated by a first inlet bore 10, which may run essentially in the vertical direction, and a second inlet bore 11, which may run essentially perpendicular to the first bore. Second inlet bore 11 discharges into a regulating slide bore 13, which may run essentially parallel to the axis of symmetry of injection timing piston 6. A piston-shaped regulating slide 12, which is provided on its face toward a cavity 24 with an outlet bore having an enlarged diameter, is introduced into regulating slide bore 13. Regulating slide 12 corresponds to a control piston and is also referred to in combination with injection timing piston 6 as a trailing or servo injection timing piston. There is a connection between a first channel 14, running transversely to the axis of symmetry of regulating slide 12, and a second channel 15 implemented in regulating slide 12, second channel 15 discharging in the region of regulating slide 12 which is implemented with an enlarged internal diameter. A slotted disk 16 is assigned to regulating slide 12 on its external circumference, which fixes the displacement path of regulating slide 12 running in the axial direction inside injection timing piston 6, the slotted disk forming a stop 22 for regulating slide 12.

Slotted disk 16 presses against second front face 18 of injection timing piston 6 inside a recess 19 of injection timing piston 6, while, in the state illustrated in FIG. 1, first front face 17 of injection timing piston 6 faces a housing delimitation wall of timing unit 5 for displacing the point of injection.

On its face toward a cavity 24, regulating slide 12 includes a support disk 20, which is used as a contact surface for a control spring 31. Control spring 31 is supported on inner side 26 of a cold-start accelerator piston 23. A disk 21 may be provided on inner side 26 of cold-start accelerator piston 23. Inner side 26 of cold-start accelerator piston 23 is additionally used as a stop surface for a first spring element 25, which is supported on an adapter plate 30 on the side diametrically opposed to inner side 26. An annular projection is implemented on adapter plate 30, which is used as a stop surface for second front face 18 of injection timing piston 6. In addition, a trailing piston/regulating slide retaining spring 32 is introduced between first spring element 25 and control spring 31. This retaining spring is supported on one side on the peripheral surface of slotted disk 16 on second front face 18 of injection timing piston 6 and on the other side on a sleeve body 34. Sleeve body 34, whose lateral surface includes individual orifices 35, has a first sleeve body stop 36 and a second sleeve body stop 37. Regulating slide/trailing piston retaining spring 32 is supported on one side on first sleeve body stop 36 and on the other side on slotted disk 16 in the region of second front face 18 of injection timing piston 6.

Face 27 of cold-start accelerator piston 23 illustrated here, which faces a pressure chamber 28, is supported on a stop 29 implemented on the housing wall of timing unit 5. An annular groove 38 is introduced into the peripheral surface of cold-start accelerator piston 23, which is connected via an outlet bore 39 to cavity 24, which is delimited by inner side 26 of cold-start accelerator piston 23, adapter plate 30, and second face 18 of injection timing piston 6 in the region of recess 19.

It may be disadvantageous in this exemplary embodiment of a high-pressure pump 1 for supplying a fuel injection system with fuel that a gap 33 exists between inner side 26 of cold-start accelerator piston 23 and first sleeve body stop 36. This gap 33 may have the effect that an uncontrolled movement of injection timing piston 6 may occur during the gradual pressure buildup in cavity 24 via inlet bores 10 and/or 11, first channel 14 and/or second channel 15 and the inner side of sleeve body 34, as well as orifices 35 implemented therein. Therefore, stable adjustment in the lower speed range of high-pressure pump 1 may be achieved with difficulty, since a clearance, which is dependent on the construction, may remain between first sleeve body stop 36 and the diametrically opposed section of inner side 26 of cold-start accelerator piston 23. Since second sleeve body stop 37 overlaps support disk 20 of regulating slide 12, the position of first sleeve body stop 36 of sleeve body 34 is fixed, due to which annular gap 33 is formed.

SUMMARY OF THE INVENTION

Using an exemplary embodiment of the present invention, a continuous application of pressure to an injection timing piston of a timing unit may be used for displacement of the injection curve. By moving the support point of a spring element which is applied directly to the injection timing piston from a movable component to a component which is stationary in the start phase, oscillation of this piston between two stop surfaces may be prevented through application to this injection timing piston. In this manner, an uncontrolled axial movement of the injection timing piston is prevented, which may favorably influence the material wear due to friction.

By integrating a spring assembly into the cavity of the timing unit for displacing the point of injection, which is delimited by the cold-start accelerator piston and the injection timing piston, two spring elements having different spring stiffnesses $c_1$, $c_2$ may be positioned on a displaceably mounted spring support ring. Spring stiffness $c_1$ may be selected to be very small, this spring stiffness being responsible for the cold start, while spring stiffness $c_2$ of the remaining spring element may be designed in regard to normal operation.

In the rest position of the high-pressure pump, i.e., when the internal combustion engine has not yet been started, the spring element of the spring assembly applied to the injection timing piston is prestressed, while the spring element assigned to the cold-start accelerator piston is in the unloaded position.

In an exemplary embodiment of the present invention in which a spring assembly in the form of two spring elements is connected in series between the cold-start accelerator piston and the injection timing piston, all injection timing piston control springs in accordance with a modular system may be used. By selecting the stiffness of the spring elements, the desired spring characteristics and therefore the curve of the prestress force may be adjusted depending on the application of the high-pressure pump. The spring element applied directly to the injection timing piston is designed in such a manner that all typical spring elements may be installed if this spring element is positioned directly on the cold-start accelerator piston. To support a first spring element, the spring element may be applied directly to the injection timing piston, and to support the spring elements of the spring assembly connected in series, a stepped arrangement of multiple contact surfaces may be implemented on the inner side of the cold-start accelerator piston. The individual contact surfaces for the spring elements may be implemented as ring surfaces.

BRIEF DESCRIPTION OF THE DRAWINGS

FIG. 5.1 shows a partial longitudinal section through the timing unit having a cold-start accelerator piston.

FIG. 5.2 shows a longitudinal section through the timing unit having a coupling spring assembly between the cold-start accelerator piston and the injection timing piston below the high-pressure pump housing.

DETAILED DESCRIPTION

Figure 1:
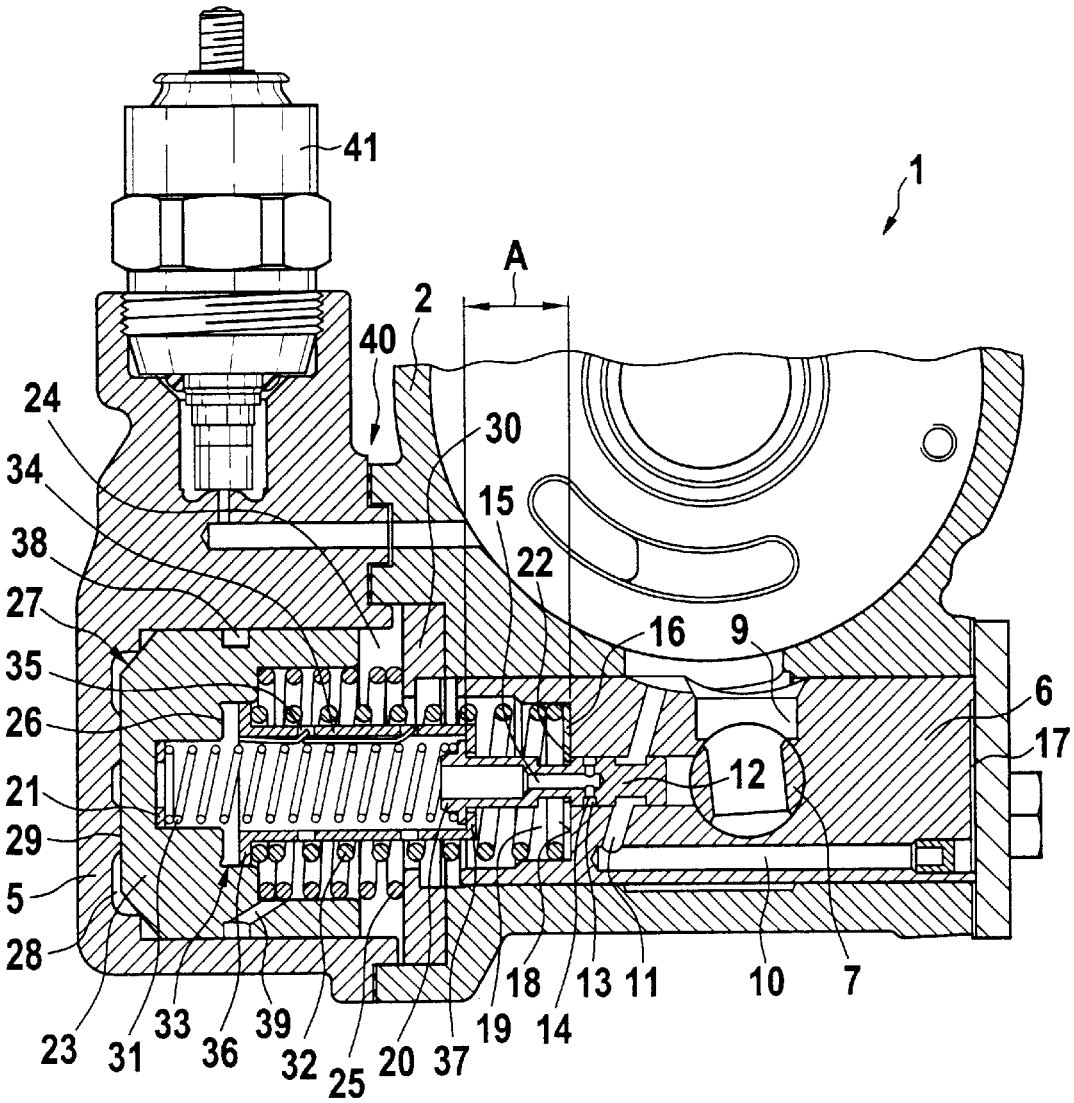
FIG. 1 shows a conventional high-pressure pump having an advance timing unit.
Figure 2:
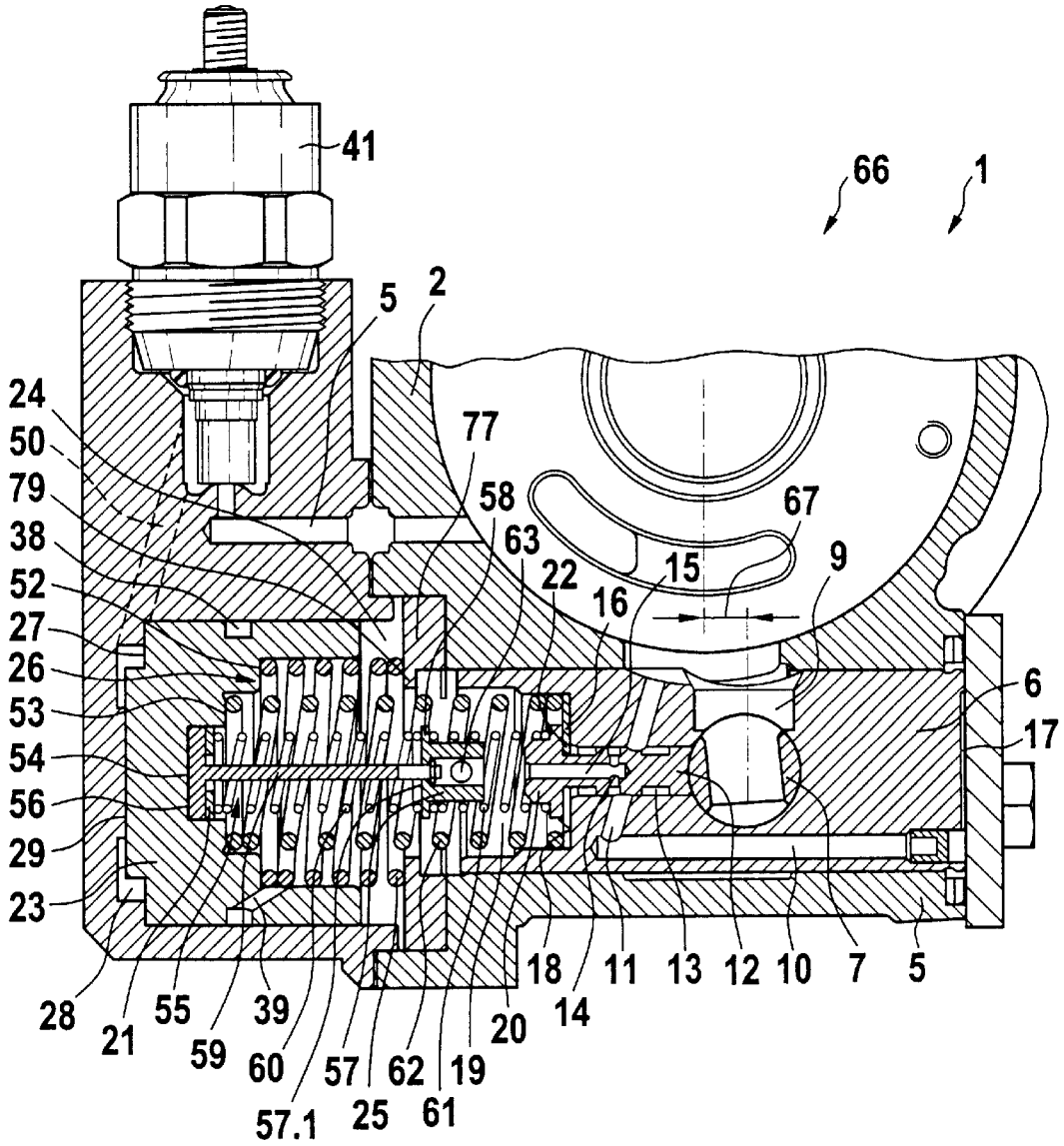
FIG. 2 shows a timing unit for displacing the point of injection in longitudinal section.

FIG. 2 shows a timing unit for displacing the point of injection in longitudinal section. Analogously to the illustration shown in FIG. 1, a timing unit 5 for displacing the point of injection is assigned to housing 2 of a high-pressure pump 1. An injection timing piston 6 is accommodated in this timing unit, which includes a pivot bearing 7, in which a lever element 8 is accommodated, which adjusts a roller ring inside high-pressure pump 1. Retarded position 66 of timing unit 5 illustrated in FIG. 2 is distinguished in that the axis of the bore of pivot bearing 7 differs from the axis of the roller ring of high-pressure pump 1 by an offset 67. Injection timing piston 6 also includes a recess 9, in which a pivoting movement of lever element 8 accommodated in pivot bearing 7 is possible, and a first inlet bore 10 as well as a second inlet bore 11, running at an angle thereto. A regulating slide bore 13 is accommodated symmetrically to the central axis of injection timing piston 6, in which a regulating slide 12 is mounted so it is adjustable in the axial direction. Regulating slide 12 includes a first channel 14 and a second channel 15 connected thereto. Furthermore, a support ring 20 is accommodated on the face of regulating slide 12 facing cavity 24. The rotational movement of regulating slide 12 is ensured using a disk-shaped element 16 implemented as a slot, which presses against second front face 18 of injection timing piston 6 in the region of a recess 19. The slotted legs of disk-shaped element 16 engage in recesses which are implemented on the external peripheral surface of regulating slide 12.

A stop for second front face 18 of injection timing piston 6 of timing unit 5 for displacing the point of injection is represented by an adapter plate 77, on which an annular stop surface 79 is implemented. Adapter plate 77 forms a stop surface for first spring element 25, which forms a first annular stop surface 52 on inner side 26 of cold-start accelerator piston 23. Through first spring element 25, which may be designed as a spiral spring, adapter plate 77 is pressed against housing 2 of high-pressure pump 1 and against timing unit 5 for displacing the point of injection. In addition, an additional spring element 62, which extends from second front face 18 of injection timing piston 6 to second contact surface 53 on inner side 26 of cold-start accelerator piston 23 and is directly applied to injection timing piston 6, runs in cavity 24, which may be essentially formed by inner side 26 of cold-start accelerator piston 23, adapter plate 77, and second front face 18 of injection timing piston 6. Through this additional spring element 62, slotted element 16, which delimits the axial movement of regulating slide 12, may always be pressed against second face 18 of injection timing piston 6.

A first face 56 of a carrier element 55 presses against a third contact surface 54 on inner side 26 of cold-start accelerator piston 23. Carrier element 55 includes an axle 59 running from first face 56 parallel to the axis of symmetry of injection timing piston 6. A stop is implemented on this axle 59, which fixes the maximum axial displacement of a spring support ring 57. Spring support ring 57, which may be essentially implemented as a cylindrical component, includes a first face 57.1 and a second face 58. A first spring element 60 of a spring assembly 60, 61 extends between a disk-shaped element 21, assigned to first face 56, and first face 57.1 of spring support ring 57. The second spring element 61 of spring assembly 60, 61 extends between second face 58 of spring support ring 57 and support ring 20 of regulating slide 12. First spring element 60 and/or second spring element 61, accommodated inside installation compartment A (cf. FIG. 1), are connected in series to one another, the position of spring support ring 57 being a function of the resulting force which first spring element 60 of spring stiffness $c_2$ and second spring element 61 having spring stiffness $c_1$ exert on spring support ring 57. Spring support ring 57 is additionally provided with orifices 63, via which fuel flowing into the inside of spring support ring 57 when the spring support ring 57 is pressed against the face of support disk 20 of regulating slide 12 flows from second channel 15 into cavity 24 and gradually fills it, i.e., results in a pressure buildup in the cavity.

In operating state 66 illustrated in FIG. 2, i.e., the operating state corresponding to the retarded position of injection timing piston 6, first channel 14 has a fluid connection to second inlet bore 11 in injection timing piston 6, so that, via second inlet bore 11, fuel may flow via first channel 14 and second channel 15 into the region of recess 19 and therefore into cavity 24. Pressure is built up or reduced via channel 50 by opening/closing a solenoid valve 41, through which cold-start accelerator piston 23 is displaced against the action of first spring element 25.

Figure 3:
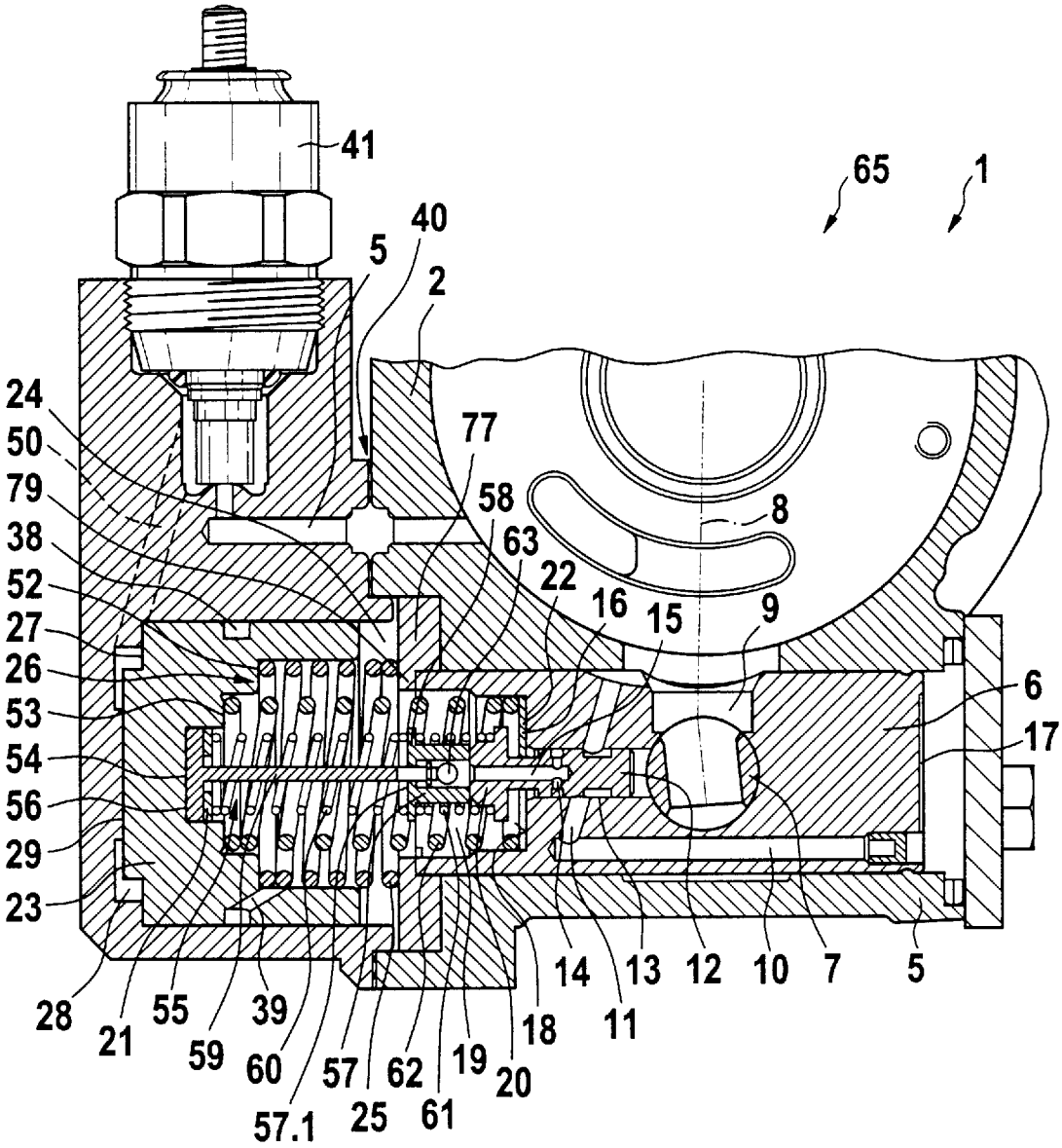
FIG. 3 shows the timing unit shown in the illustration in FIG. 2 with the injection timing piston in the advanced position.

In FIG. 3, the timing unit shown in FIG. 2 having a timing unit for displacing the point of injection is reproduced, with the injection timing piston being set in the advanced position. In this position of injection timing piston 6 in the direction of an advanced point of injection, indicated with reference number 65, in comparison to the illustration shown in FIG. 2, injection timing piston 6 is in a state pressed against stop ring 79 of adapter plate 77. In this state, first front face 17 of injection timing piston 6 is at a distance to the wall on the housing side, while in contrast, regulating slide 12 is moved out of its regulating slide bore 13 into the inside of injection timing piston 6. Due to this, a connection between first inlet bore 11 and first channel 14, which penetrates regulating slide 12 perpendicular to the first axis of symmetry, is cut off. Offset 67, illustrated in FIG. 2, between the center of pivot bearing 7 of injection timing piston 6 and the center of rotation of the components of high-pressure pump 1 no longer exists, i.e., these centers of rotation are on a vertical line.

Regulating slide 12 is implemented as a slide valve and is brought into equilibrium with the trailing piston springs by the suction chamber pressure arising via orifice 9, and thus controls the position of injection timing piston 6.

It may be seen in the illustration shown in FIG. 3 that in this operating state of timing unit 5 for displacing the point of injection, support ring 57 and support disk 20 of regulating slide 12 press against one another. The second spring element, having spring stiffness $c_1$, which is introduced between second face 58 of spring support ring 57 and the corresponding contact surface of support disk 20 of regulating slide 12, is correspondingly compressed. In contrast, first spring element 60, having spring stiffness $c_2$, of spring assembly 60 and/or 61 may essentially remains in its position already shown in FIG. 2. Spring support ring 57 is thus displaced on axle 59 of carrier 55 as a function of the axial displacement path of regulating slide 12, through support disk 20 provided on its face, until a force equilibrium has been reached inside spring assembly 60 and/or 61 and no further displacement of support ring 57 on axle 59 of carrier 55 occurs.

In advanced position 65 of injection timing piston 6, pressure chamber 28 assigned to face 27 of cold-start accelerator piston 23 is relieved of pressure. A fluid connection between an inlet 51 to actuator 41 and a pressure chamber bore 50 discharging into its valve chamber may be cut off and/or released via an actuator, in the form of an electromagnet 41, assigned to timing unit 5 for displacing the point of injection. In the state illustrated, which corresponds to advanced position 65 of injection timing piston 6, pressure chamber 28 is depressurized, analogously to the illustration shown in FIG. 2; i.e., actuator 41, in the form of a solenoid valve, seals inlet 51 from high-pressure pump 1.

Figure 4:
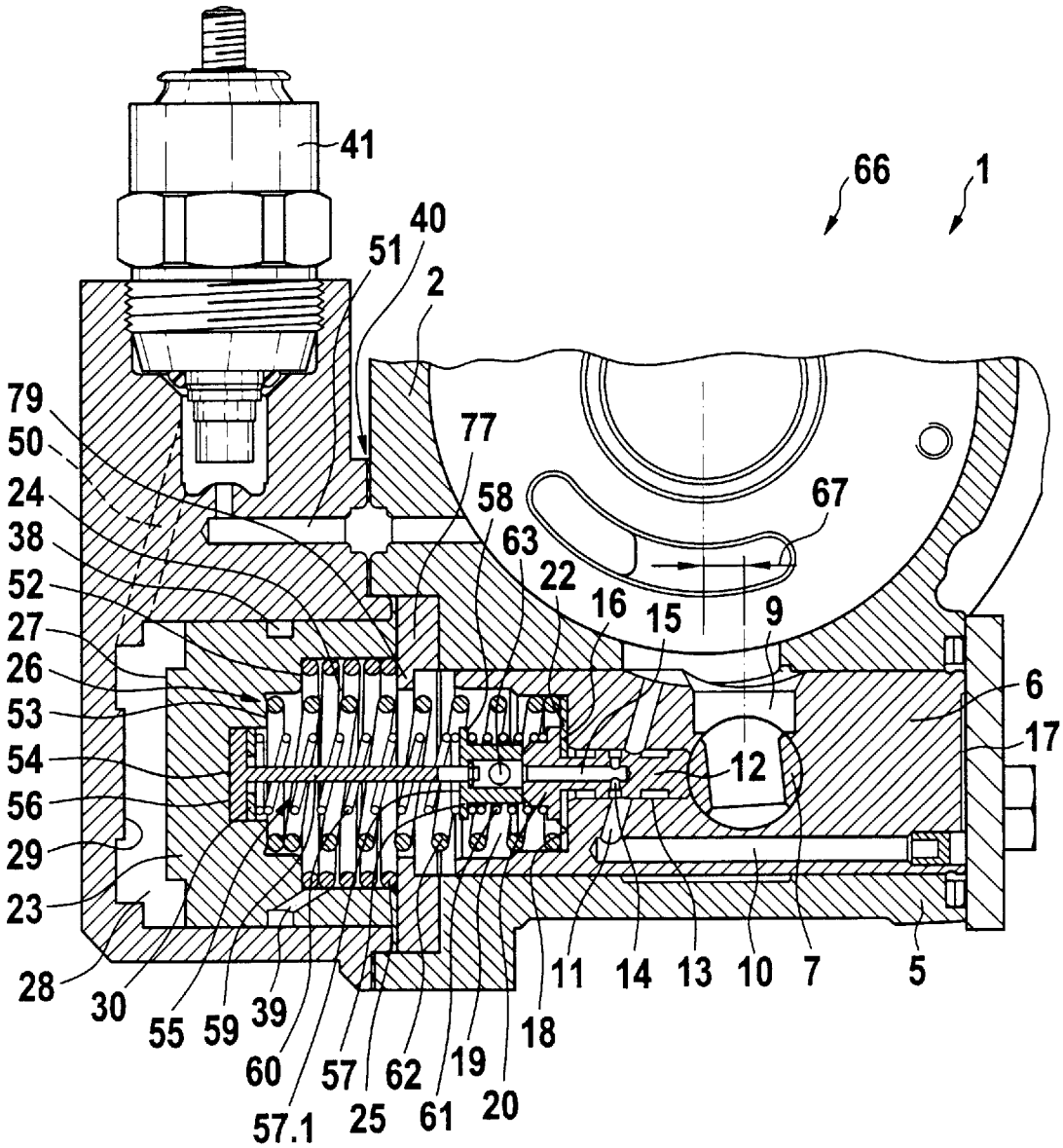
FIG. 4 shows the timing unit in the stationary state of the high-pressure pump with the injection timing piston in the retarded position.

FIG. 4 shows the timing unit for displacing the point of injection in the stationary state of the high-pressure pump, with the injection timing piston set in the retarded position.

It may be seen in the illustration shown in FIG. 4 that inlet 51 to the actuator in the form of a solenoid valve 41 is released by the actuator and fuel shoots into pressure chamber 28 through the valve chamber assigned to solenoid valve 41 via pressure chamber bore 50. Through the gradual increase in pressure in pressure chamber 28, face 27 of cold-start accelerator piston 23 has pressure applied to it in such a manner that its inner side 26 moves toward adapter plate 77, on which an annular stop surface 79 is implemented. With increasing pressure in pressure chamber 28, cavity 24, which is delimited by inner side 26 of cold-start accelerator piston 23, adapter plate 77, and second front face 18 of injection timing piston 6, is relieved of pressure through outlet bore 39 in combination with an annular groove 38 implemented on the lateral surface of cold-start accelerator piston 23 (cf. the detail shown in FIGS. 5.1 and 5.2).

First spring element 25 is compressed as cold-start accelerator piston 23 presses against adapter plate 77. The same is true for additional spring element 62, which is applied directly to regulating slide 12 and/or the trailing piston, whose contact surface 53 is moved toward second front face 18 of injection timing piston 6 in the event of axial movement of cold-start accelerator piston 23. In this manner, the prestress generated by additional spring element 62 increases, i.e., the injection timing piston is adjusted from its advanced position 65, illustrated in FIG. 3, into its retarded position 66, illustrated in FIG. 4.

A displacement of carrier 55, which accommodates spring support ring 57, occurs simultaneously with the axial movement of cold-start accelerator piston 23 toward adapter plate 77. Its first face 56 presses against third contact surface 54 on the bottom of inner side 26 of cold-start accelerator piston 23. During an axial movement, carrier 55, with spring support ring 57, which has the first spring element having spring stiffness $c_2$ applied to it, accommodated displaceably thereon, moves in the direction toward support disk 20 of regulating slide 12. When the side of spring support ring 57 opposite to support disk 20 presses against regulating slide 12, this slide is pressed against slotted disk element 16 up to the stop. In the state of regulating slide 12 in which it is inserted into injection timing piston 6, its first channel 14 and second channel 15 of regulating slide 12, which is connected thereto, are connected to second inlet bore 11 of injection timing piston 6. During the axial displacement due to the increase in pressure in pressure chamber 28 of cold-start accelerator piston 23, spring assembly 60, 61 is pressed against support disk 20 of regulating slide 12 until regulating slide 12 is again inserted completely into its regulating slide bore 13.

If the internal combustion engine is turned off in this state and cools down, when the internal combustion engine is started, first inlet bore 10 and/or second inlet bore 11 are connected to first channel 14 and therefore to second channel 15 of regulating slide 12. In the illustration shown, fuel flows into cavity 24 via the above-mentioned bores and/or channels and orifice 63 in spring support ring 57. Since inlet 51 from housing 2 of high-pressure pump 1 may be simultaneously sealed by solenoid valve 41, and therefore pressure chamber bore 50 is depressurized, cold-start accelerator piston 23 travels, due to the pressure buildup in cavity 24, until it presses against stop 29 on the wall of timing unit 5. As a function of the movement of face 27 of cold-start accelerator piston 23 toward stop surface 29, injection timing piston 6 travels, due to the decreasing pressure in cavity 24, into this cavity, until its annular second face 18 presses against stop ring 79 of adapter plate 77. Offset 67 illustrated in FIG. 4, which corresponds to a retarded position offset, becomes zero, i.e., high-pressure pump 1 is adjusted in such a manner that the point of injection during the start and the immediately subsequent cold-running phase of the compression-ignited internal combustion engine are advanced.

Figure 5:
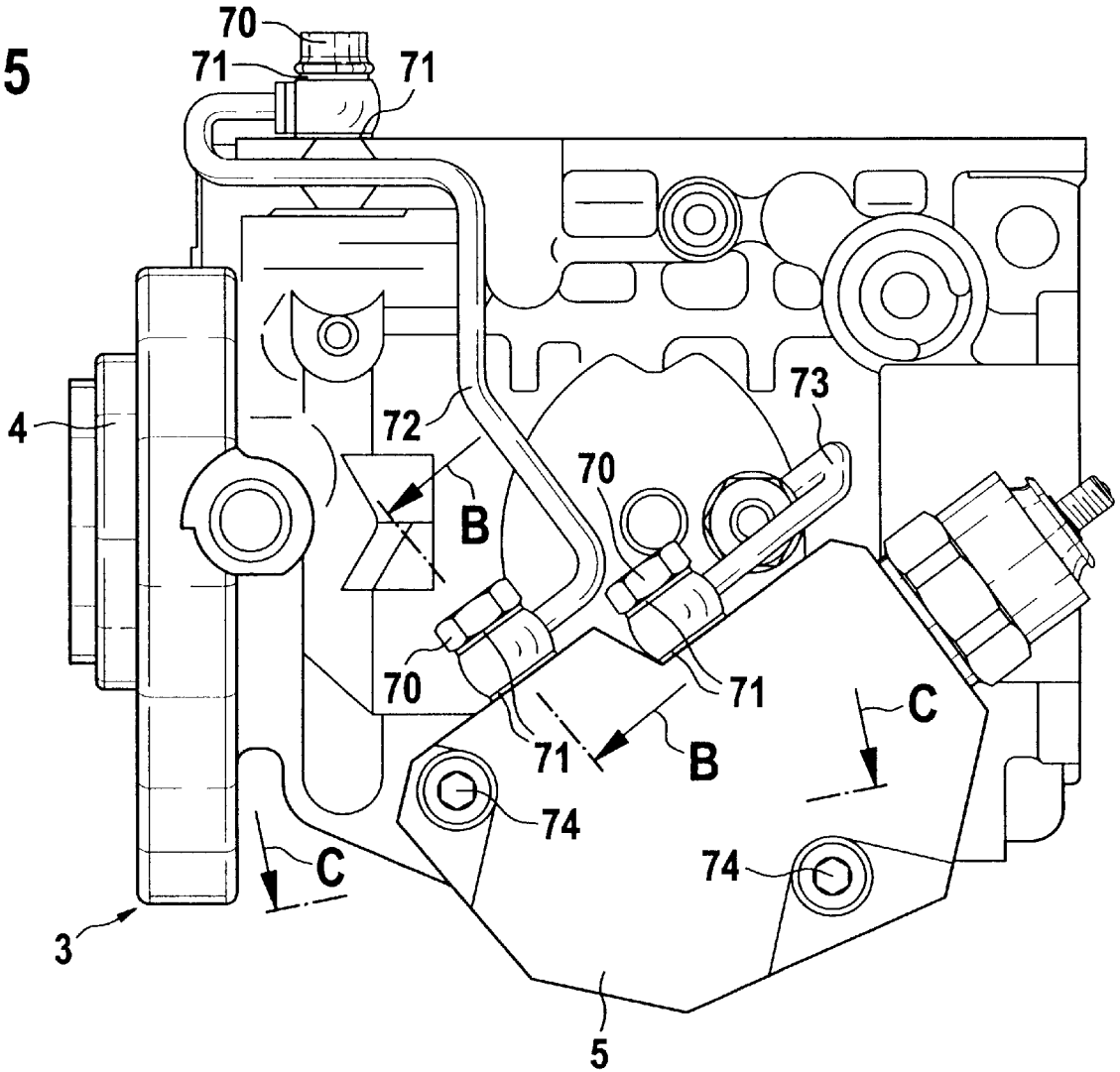
FIG. 5 shows a side view of the high-pressure pump.

FIG. 5 shows a schematic illustration of a side view of the high-pressure pump.

A housing 2 of a high-pressure pump 1 for supplying an internal combustion engine with fuel under high pressure is illustrated in a side view. The drive side of the high-pressure pump is indicated using reference number 3, on which a schematically indicated belt pulley 4 is implemented, which initiates the drive in the high-pressure pump via a belt drive.

A timing unit 5, which is used to displace the point of injection, is flange-connected laterally onto housing 2 of high-pressure pump 1. The flange bolts, using which timing unit 5 is flange-connected onto housing 2 of high-pressure pump 1, are indicated using reference number 74.

Timing unit 5 is connected to housing 2 of the high-pressure pump via a first connecting pipe 72. First connecting pipe 72 is attached to a hollow screw 70 having sealing elements 71 on housing 2 of high-pressure pump 1 and is connected using an additional hollow screw 70 in the region of cold-start accelerator piston 23 of timing unit 5 for displacing the point of injection. In addition, additional hollow screw 70 is assigned flat sealing rings 71, analogously to first hollow screw 70 described. Furthermore, a second connecting pipe 73 extends from timing unit 5 for displacing the point of injection to housing 2 of high-pressure pump 1, which may be simultaneously connected pressure-tight using hollow screws 70.

FIG. 5.1 shows a partial longitudinal section through the timing unit for displacing the point of injection having a cold-start accelerator piston.

It may be seen in the illustration shown in FIG. 5.1, which corresponds to the section line B-B illustrated in FIG. 5, that a threaded connection 75 for a hollow screw 70 is provided in the housing of timing unit 5. An annular groove 38, which is connected via an outlet bore 39 to cavity 24, delimited by cold-start accelerator piston 23 and injection timing piston 6, is provided below connection 75 for hollow screw 70 on the lateral surface of cold-start accelerator piston 23. In the illustration shown in FIG. 5.2, face 27 of cold-start accelerator piston 23 presses against housing-side stop 29. Inner side 26 of cold-start accelerator piston 23 is designed so that multiple stop surfaces 52 and/or 53, which first spring element 25 and first face 56 of a carrier 55 press against, are implemented on the inner side of cold-start accelerator piston 23. In addition to supporting first spring element 60, first face 56 of the carrier shown in the illustration in FIG. 5.2 is used for supporting additional spring element 62, which is applied directly to first face 18 of injection timing piston 6. A spring support ring 57 is mounted on axle 59 of carrier 55, whose first side 57.1 is used as a stop surface for first spring element 60, implemented with spring stiffness $c_2$. Second stop surface 53 of spring support ring 57 supports second spring element 61 of spring assembly 60 and/or 61, the second spring element being implemented with a spring stiffness $c_1$ and being applied to support disk 20 of a regulating slide.

The illustration shown in FIG. 5.2 is a longitudinal section through the timing unit for displacing the point of injection having a coupling spring assembly between the cold-start accelerator piston and the injection timing piston.

In contrast to the illustration shown in FIGS. 2, 3, and 4, only two stop surfaces for spring elements are implemented on inner side 26 of cold-start accelerator piston 23. First spring element 25 presses against first contact surface 52, while second contact surface 53 and third contact surface 54 shown in the illustration in FIGS. 2, 3, and 4 are combined into a stop surface for first face 56 of spring carrier 55. A spring support ring 57 is displaceably accommodated on axle 59, which extends from first face 56 of carrier 55 and has a stop. First side 57.1 of spring support ring 57 has a first spring element 60, implemented with spring stiffness $c_2$, applied to it, while a second spring element 61, implemented with spring stiffness $c_1$, extends from second side 58 of spring support ring 57 to support disk 20 of regulating slide 12. Analogously to the illustrations shown in FIGS. 2, 3, and 4, regulating slide 12 is displaceably guided inside injection timing piston 6 in a regulating slide bore 13. Analogously to the illustrations shown in FIGS. 2,3, and 4, injection timing piston 6 includes a pivot bearing 7, into which a lever projection 8 for adjusting an actuator on a high-pressure pump 1 projects. In order to allow a pivoting movement of lever projection 8 during axial displacement of injection timing piston 6, an oblong recess 9 is located above pivot bearing 7.

A first inlet bore 10, which discharges into an inlet bore 11 running at an angle thereto, extends through injection timing piston 6. First channel 14 in regulating slide 12, which is connected to a second channel 15, may have pressure applied to it via second inlet bore 11. Second channel 15 of regulating slide 12 discharges in the region of the face of a support disk 20, on which second spring element 61, implemented with spring stiffness $c_1$, is supported. An adapter plate 77, on which an annular stop surface 79 is implemented, is located between housing 5 of the timing unit and a housing 2 of the high-pressure pump 1. Stop surface 79 forms the contact surface for second face 17 of injection timing piston 6, reference number 78 indicating a gasket plate.

Cold-start accelerator piston 23 has a first spring element 25 applied to it, analogously to the embodiments shown in the illustrations in FIGS. 2, 3, and 4. Additional spring 62 (additional spring element 62), which is applied directly to the second front face of injection timing piston 6, is supported on first face 56 of carrier 55, illustrated in FIG. 5.3 in a modified embodiment.

The pressure relief of cavity 24 between inner side 26 of cold-start accelerator piston 23, adapter plate 77, and second front face 18 of injection timing piston 6 is performed through outlet bore 39, extending through the wall of cold-start accelerator piston 23, which discharges into an annular groove 38 on the lateral surface of cold-start accelerator piston 23. As shown in FIG. 5.2, annular groove 38 is assigned a hollow screw connection 70 and/or 75, via which excess fuel in housing 2 of high-pressure pump 1 may be drained off using first connecting pipe 72 (compare the illustration shown in FIG. 5).

The position of the injection timing piston when the internal combustion engine is at a standstill but solenoid valve 41 is supplied with current is shown in FIG. 5.2. The internal combustion engine is in this state when the engine performs a warm start.

What is claimed is:

1. A timing unit for a high-pressure pump for supplying an internal combustion engine with fuel, the timing unit displacing a point of injection and being accommodated on a housing of the high-pressure pump, comprising:

a cold-start accelerator piston;

an injection timing piston having inlet bores;

a regulating slide movably accommodated in the injection timing piston, a face of the regulating slide facing the cold-start accelerator piston having an applied prestress force; and a first spring element, and a separate spring assembly accommodated on a carrier, positioned between the cold-start accelerator piston and the face of the injection timing piston;

wherein the first spring element acts directly on a stop of the injection timing piston, and wherein the spring assembly acts on the regulating slide.

2. The timing unit as recited in claim 1, wherein the spring assembly includes a plurality of spring elements connected in series.

3. The timing unit as recited in claim 1, wherein the spring assembly includes a second spring element and a third spring element supported on a spring support ring, the spring support ring being movably accommodated on the carrier.

4. The timing unit as recited in claim 3, wherein the spring support ring includes a first side and a second side.

5. The timing unit as recited in claim 3, wherein the second spring element is accommodated between the cold-start accelerator piston and the spring support ring, and has a first spring stiffness.

6. The timing unit as recited in claim 3, wherein the third spring element is accommodated between the injection timing piston and the spring support ring, and has a second spring stiffness.

7. The timing unit as recited in claim 1, wherein the cold-start accelerator piston includes a plurality of stepped contact surfaces on an interior surface of the cold-start accelerator piston, the interior surface facing toward a cavity.

8. The timing unit as recited in claim 7, wherein a fourth spring element is accommodated between a first contact surface of the cold-start accelerator piston and an adapter plate, the adapter plate forming a stop ring for the injection timing piston.

9. The timing unit as recited in claim 7, wherein the first spring element acting directly on the stop of the injection timing piston presses against a second contact surface of the cold-start accelerator piston.

10. The timing unit as recited in claim 1, wherein the first spring element acting on the face of the injection timing piston presses a slotted disk against the face, a plurality of slotted legs of the slotted disk engaging a plurality of recesses provided, limiting an axial displacement path of the regulating slide.

11. The timing unit as recited in claim 6, wherein the third spring element of the spring assembly is accommodated between the spring support ring of the carrier and a support ring of the regulating slide.

12. The timing unit as recited in claim 1, wherein:

the regulating slide includes a channel, the channel extending through a support ring; and when the regulating slide is pressed against a spring support ring, a cavity between the cold-start accelerator piston and the injection timing piston inside the timing unit is filled with fuel via a plurality of orifices provided on the spring support ring.

* * * * *